US005412815A

United States Patent [19]

Ellis

[11] Patent Number: 5,412,815

[45] Date of Patent: May 9, 1995

[54] TOILET SEATS

[75] Inventor: William E. Ellis, Allestree, England

[73] Assignee: Gordon Ellis and Company, Derby, England

[21] Appl. No.: 250,915

[22] Filed: May 31, 1994

[51] Int. Cl.[6] ..... A47K 13/02; A47K 13/26

[52] U.S. Cl. ..... 4/239; 4/237

[58] Field of Search ..... 4/235, 237, 239, 483

[56] References Cited

U.S. PATENT DOCUMENTS

| | | | |
|---|---|---|---|
| D. 239,715 | 4/1976 | Finlof | 4/239 |
| 2,493,362 | 1/1950 | Rocker | 4/237 |
| 2,539,481 | 1/1951 | Rosenheim | 4/237 |
| 3,364,505 | 1/1968 | Palmier | 4/239 |
| 3,609,775 | 10/1971 | Leiter et al. | 4/230 |
| 3,671,981 | 6/1972 | Smith | 4/242 |
| 4,213,211 | 7/1980 | Benis et al. | 4/235 |
| 4,462,122 | 7/1984 | Broeils | 4/239 |
| 4,477,932 | 10/1984 | Lenosky | 4/237 |
| 5,251,338 | 10/1993 | Light | 4/235 |
| 5,311,617 | 5/1994 | Ammatelli et al. | 4/237 |

FOREIGN PATENT DOCUMENTS

| | | | |
|---|---|---|---|
| 641292 | 4/1964 | Belgium . | |
| 0161352 | 11/1985 | European Pat. Off. | A47K 13/28 |
| 2643249 | 8/1990 | France | A47K 13/06 |
| 624841 | 8/1981 | Switzerland | A47K 13/00 |

OTHER PUBLICATIONS

Sears "Our Finest Elevated Toilet Seat" Jul. 2, 1992.

*Primary Examiner*—Henry J. Recla
*Assistant Examiner*—Charles R. Eloshway
*Attorney, Agent, or Firm*—W. Thad Adams, III

[57] ABSTRACT

A raised toilet seat is formed from plastic material as a single member by injection molding and includes a seat surface from which inner and outer flanges depend. The flanges form an open bottomed channel in which are located integral strengthening webs. The lower surface of the webs engage the toilet bowl, and three-point clamps integrally-formed with one of the flanges form a downward extension. A pair of rear clamping members is mounted in threaded passages in extensions from the outer flange.

5 Claims, 3 Drawing Sheets

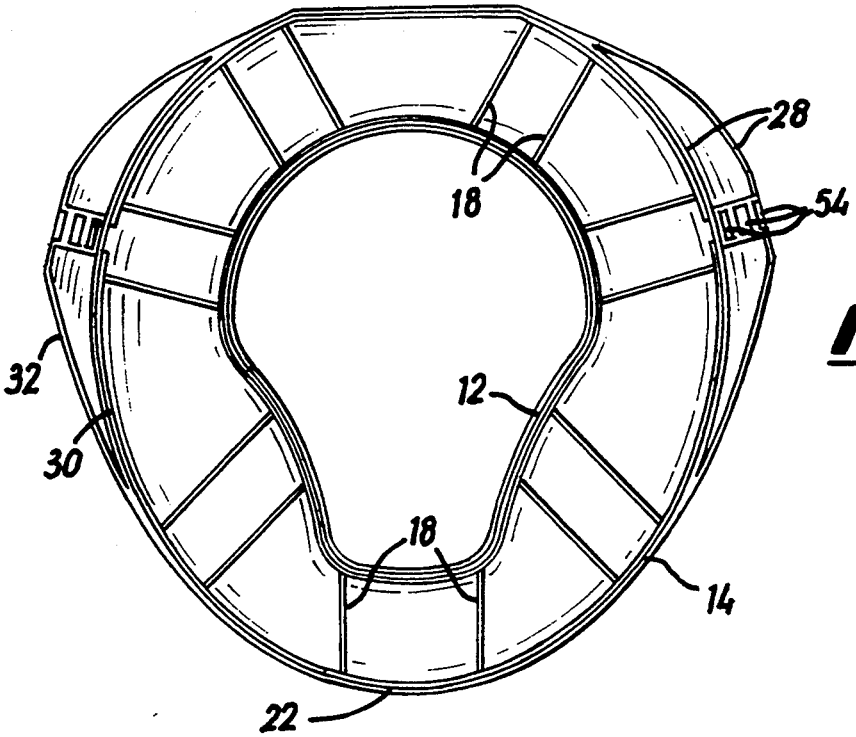
FIG. 6
FIG. 7
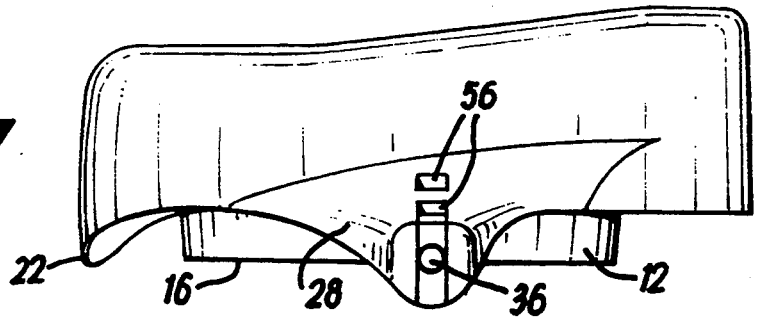
FIG. 8
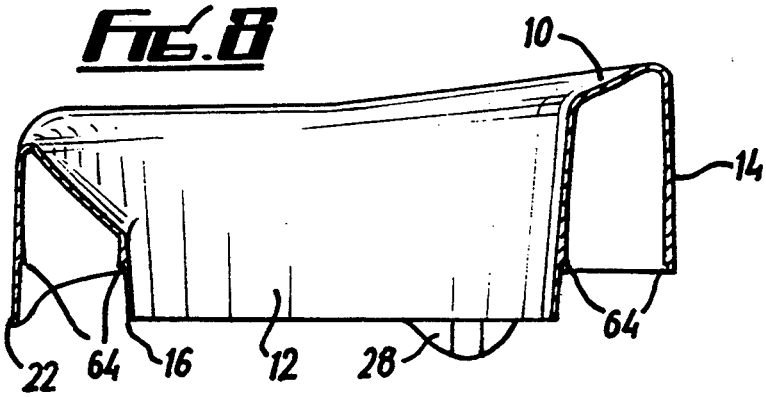
FIG. 10
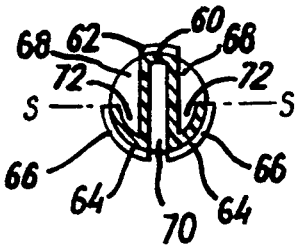
FIG. 9
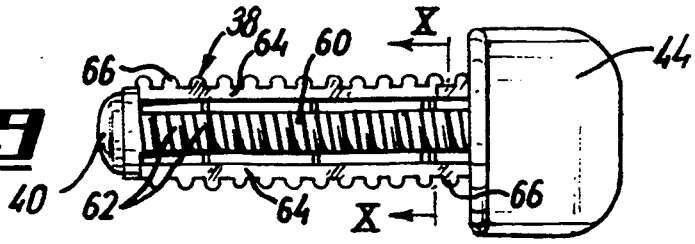

TOILET SEATS

The present invention concerns improvements in or relating to toilet seats.

It has been found that the height from the floor of a normal toilet seat presents difficulties to certain users and these difficulties can be mitigated if the seat is raised. In the past there have been provided a number of different designs of toilet seats intended to replace standard toilet seats and to provide a raised seating surface.

Once such prior design has been fabricated from plastics material from a number of components which are fixed together by gluing, screwing or any other suitable means. Whereas seats of this nature have proved to be satisfactory, they have been relatively expensive to produce.

It is important that, in use, the toilet seat is held against movement on the toilet bowl and as a result, it is necessary to provide clamping means. Normally such clamping means comprise a three point clamp assembly and in view of the variation in shapes and sizes of toilet bowls the clamping means at, at least, two locations must be adjustable. On prior arrangements adjustable clamping means have been provided by brackets which are adjustably and releasably mounted to the underside of the toilet seat by bolts threadably carried by the seat. This has involved the use of further components and certain difficulties when fitting the seat to the bowl.

It is an object of the present invention to obviate or mitigate disadvantages exhibited by prior toilet seats.

According to a first aspect of the present invention there is provided a raised toilet seat including, formed integrally from a mouldable material, a toilet seat surface, toilet bowl engaging means for supporting the surface a predetermined distance above a toilet bowl and clamping means projecting downwardly relative to the toilet bowl engaging means at, at least three mutually spaced locations.

Preferably the mouldable material is plastics material and the raised toilet seat is formed by injection moulding or rotational moulding.

Preferably flanges project downwardly from the outer and inner peripheries of the seat surface to define a downwardly opening channel below said seat surface.

Preferably said toilet bowl engaging means are located within said channel.

According to another aspect of the present invention there is provided a raised toilet seat comprising a toilet seat surface, downwardly depending flanges extending from the outer and inner periphery of the surface to define a downwardly opening channel below the seat surface, toilet bowl engaging means in said channel by which the seat can be supported on a toilet bowl and clamping means adapted to engage the toilet bowl to hold the seat against displacement, said seat being manufactured in one piece by injection moulding from a plastics material.

Preferably the toilet bowl engaging means comprise a plurality of webs formed between the outer and inner flanges. The webs preferably extend from the underside of the seat surface and terminate on a plane which is generally parallel to the plane of the seat surface.

Preferably the outer flange is intended in use to be generally on a level with the level of the top of the toilet bowl. At the front of the outer flange there may be provided a downwardly directed extension intended, in use, to project below the level or the top or the toilet bowl and define a clamping means.

Preferably two further downwardly depending extensions from the outer flange may be provided on either side of the seat in the region of the rear of the toilet seat to define further clamping means. Said further extensions preferably each provide a passage for accommodating a threaded member adapted to clamp the seat to the toilet bowl.

Preferably said threaded passages are provided during the injection moulding process by the injection moulding tool, the two components of which are split on a plane which is substantially parallel to the plane of the toilet seat surface so that the tool components can move away from each other in a direction perpendicular to said plane to release a moulded toilet seat.

Preferably each threaded passage comprises one or more upper semi-circular segments having a void therebelow for tool withdrawal and one or more lower semi-circular segments having the void thereabove for tool withdrawal spaced in the axial direction of the passage from its neighbors but adjacent thereto.

Preferably the threaded member is manufacturered by injection moulding by a two part separable tool, the member comprising three circumferentially spaced segments, separated by co-planar grooves, the grooves permitting tool withdrawal after moulding.

Preferably the plastics material from which the toilet seat is manufactuered is sufficiently temperature resistant that it can be sterilised by autoclaving.

Preferably a lid is provided for closing the downwardly opening channel.

An embodiment of the invention will now be described by way of example only with reference to the accompanying drawings in which:

FIG. 6 shows a view from below;

FIG. 7 shows a side elevation;

FIG. 8 shows a sectional elevation on the line II—II of FIG. 3;

FIG. 9 shows an elevation of a clamping screw; and

FIG. 10 shows a cross-section on the line X—X of FIG. 9.

Figure 1:
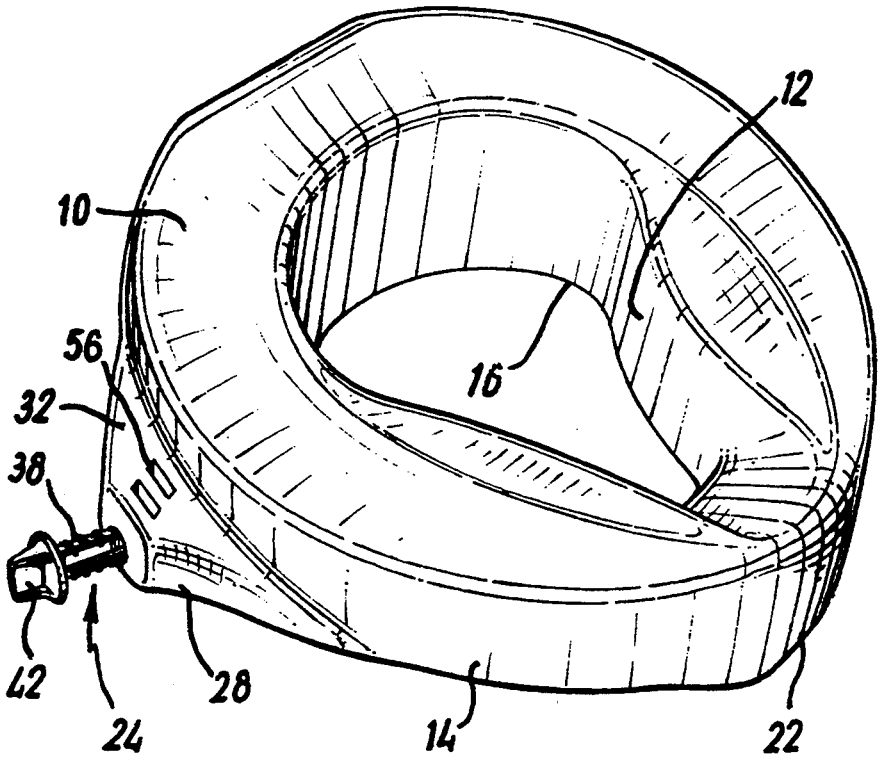
FIG. 1 shows a perspective view from the front, one side and above.

A raised toilet seat for fitment to the top of a normal toilet bowl comprises a toilet seat surface 10 which is generally similar to a normal toilet seat surface but has depending downwardly from its outer and inner peripheries continuous flanges or skirts 12,14. The depth of the inner flange 12 is such that its lower edge 16 projects into the toilet bowl whereas the depth of the outer flange 14 is such that it, in use, it is level with the upper edge of the toilet bowl. The seat surface 10 and flanges 12,14 thus define an inverted channel.

a gap between the outer and inner flange is spanned by a plurality of strengthening webs 18, the lower surfaces 20 of which are intended, in use, to support the seat on the upper edge of the toilet bowl. As a result of this, the lower edges of the webs 18, or at least the majority of the webs 18 lie on the same, in use horizontal, plane.

A downwardly extending extension 22 is provided on the forward end of the outer flange 14 and, in use, this extension prevents movement of the seat towards the rear of the bowl. Further movement of the seat is prevented by a pair of opposed clamping assemblies 24 arranged on further extensions 28 of the outer flange 14 in the region of the rear of the toilet seat. Each extension 28 comprises a double wall, one of which 30 is a downward extension of the outer flange 14, the other of which 32, takes the form of a cowling which commences from a position part way up the outer flange 14 and bulges outwardly and downwardly so that its lower edge corresponds with the lower edge of the extension 30.

Figure 2:
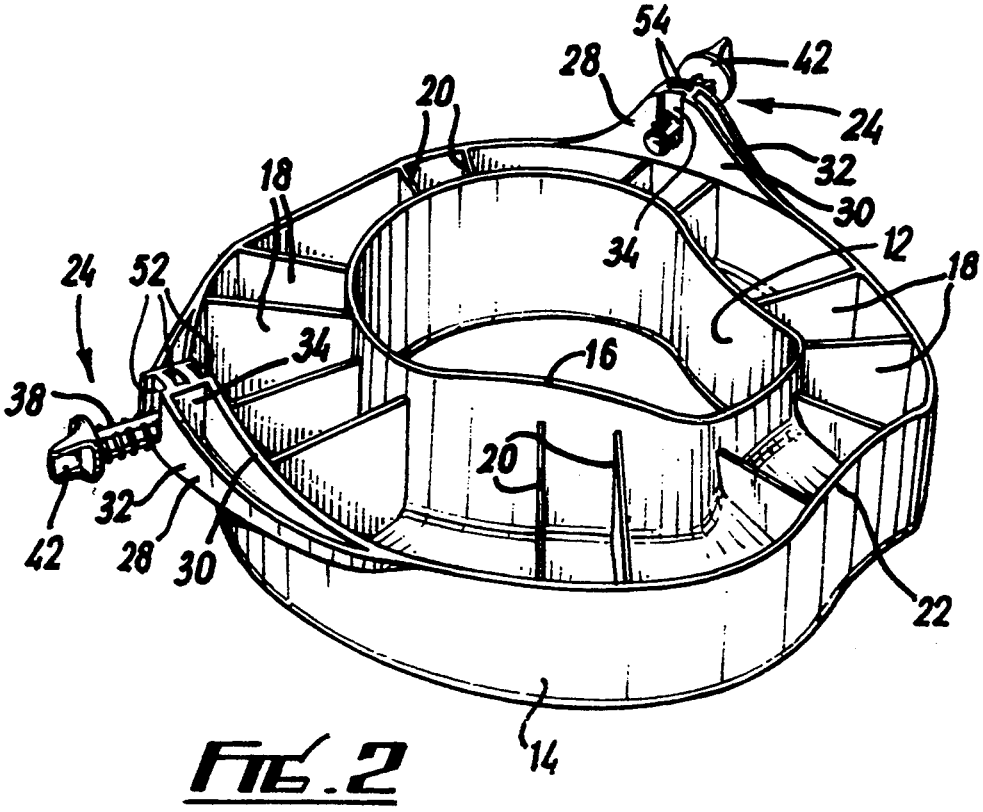
FIG. 2 shows a perspective view from the front, the other side and below.
Figure 3:
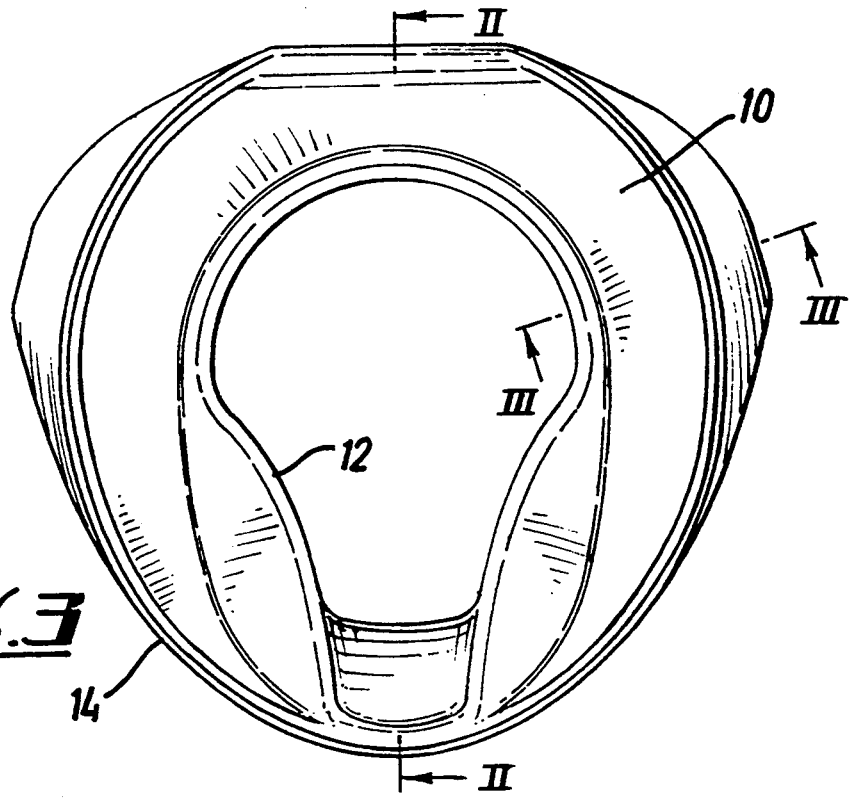
FIG. 3 shows a top plan view.
Figure 4:
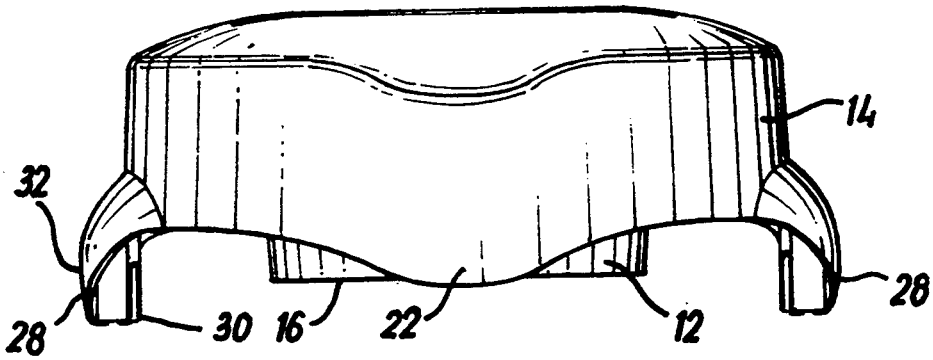
FIG. 4 shows a front elevation.
Figure 5:
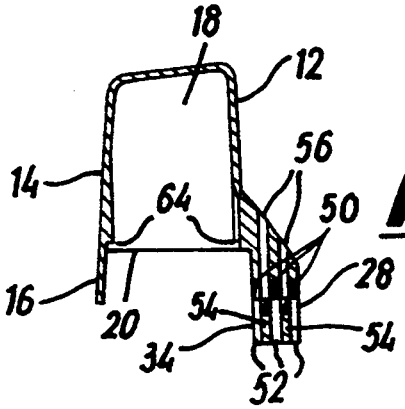
FIG. 5 shows a sectional elevation on the line III—III of FIG 3.

As can be best viewed from FIGS. 2 and 5 the block of material 34 extends between the cowl 32 and the inner extension 30 and includes a threaded passage 36 for reception of a threaded clamping member 38. Each threaded member 38 includes three circumferentially-spaced thread segments 66 separated by co-planar grooves. The raised toilet seat can be clamped on the bowl against movement laterally thereto and upwardly thereof by screwing the threaded members 38 into the passages 36 until they abut the sides of the toilet bowl. The ends of the threaded members 38 may be provided with protective pads 40 of a rubber or resilient plastic material and the outer ends may be provided with wings 42 or knobs 44 to assist in their movement.

For ease of manufacture and economy the raised toilet seat is manufactured from a plastics material by an injection moulding operation involving only two tool components, the plane of the split between the tools being substantially parallel to the plane in which the toilet seat surface 10 lies, that is the in use horizontal plane.

It will be observed that the configuration of the toilet seat surface 10 and the downwardly depending flanges 12, 14, as well as the strengthening webs 18, present no problems in the separation of the tool halves but care has to be given to the formation during the moulding operation of the two threaded passages 36 for the clamping screws 38 as these passages run perpendicularly to the direction of tool separation. Each threaded passage is formed using the same tooling by forming three upper semi-circular segments 50 (FIG. 5) having three voids 52 (FIG. 2) for tool removal formed in the section of the block 34 therebelow. Two lower semi-circular segments 54 (FIGS. 2 and 5) are provided alongside but in staggered relationship with the upper segments 50 and each has a void 56 for tool removal formed in the block 34 thereabove. A portion of a continuous female thread is formed on each semicircular segment 50,54 and, in use, receives the threaded member 38 which, in consequence is not embraced by a thread continuously round its periphery, rather it is engaged at five mutually spaced semi-circular threaded segments.

The threaded member 38 may also be formed from the same plastics material by an injection moulding technique involving a two-part separable tool. The threaded member does not have a continuous circular circumference but comprises an upper segment 60 having projecting from its outer surface thread portions 62 and two lower segments 64 each carry thread portions 66 which along with the thread portions 62 form a continuous thread which is engageable with the threads in the threaded passage.

The segment 60 is separated from the threaded portion 62 by two effectively removed segments 68 end the segments 64 are separated from each other by a further removed segment in the form of an upwardly directed channel 70. Downwardly projecting slots 72 extend into the segment 64 from the removed segment 68 and it will be appreciated, especially by considering FIG. 10 that the threaded member 38 can be formed by a two-part injection moulding tool the top part of which is separable from the lower part along the plane S—S shown in FIG. 10.

The plastics material from which the raised toilet seat is moulded is chosen such that it can withstand the heat of autoclaving.

Various modifications can be made without departing from the spirit of the invention. In one modification a lid may be fitted over the open base of the channel formed between the flanges 12 and 14. To facilitate fitment of the lid ledges 64 are Formed at the base of the flanges.

In a further modification the threaded passages could be formed by normal thread forming techniques involving the use of a threaded mandrel which, at separation of the mould halves is rotated to cause its withdrawal without destroying the threads.

In a still further modification the toilet seat is formed by a rotational moulding technique, Clearly this would call for a different design but irrespective of the design the extensions forming the clamping means would be formed integrally with the raised seat portion and the flanges or seat supporting portion.

I claim:

1. A raised toilet seat adapted to be supported on a toilet bowl, comprising:

(a) a toilet seat surface, wherein the seat surface includes downwardly depending inner and outer flanges extending, respectively, from an inner and outer periphery of the surface to define a downwardly opening channel below the seat surface, the outer flange is intended in use to be generally on a level with a level defined by top of the toilet bowl and is provided at its front with a first downwardly directed extension intended, in use, to project below the level of the top of the toilet bowl, said inner flange and said first extension cooperating to provide a first clamping means adapted to engage the toilet bowl to hold the seat against displacement;

(b) toilet bowl engaging means formed in said channel for supporting the toilet seat on a toilet bowl, (c) said seat being formed in a single piece from injection or rotational molded plastic material; and (d) second and third extensions downwardly depending from the outer flange are provided on opposite sides of the seat in a rearward region of the seat to define a second clamping means, each of said second and third extensions including a threaded passage for accommodating a threaded member adapted to clamp the seat to the toilet bowl.

2. A raised toilet seat as claimed in claim 1, wherein the threaded passages are injection molded in an injection molding tool having two components which are split on a plane which is substantially parallel to a plane defined by the toilet seat surface so that the molding tool components can move away from each other in a direction perpendicular to said plane to release a molded toilet seat.

3. A raised toilet seat as claimed in claim 2, wherein each threaded passage comprises one or more upper semi-circular segments each having a void therebelow for tool withdrawal.

4. A raised toilet seat as claimed in claim 3, wherein each threaded member is injection molded from a moldable material by a two part separable tool, each threaded member including three circumferentially spaced segments separated by co-planar grooves for permitting tool withdrawal after molding.

5. A raised toilet seat as claimed in claim 1, wherein the toilet bowl engaging means includes a plurality of webs formed between the outer and inner flanges, the webs extending from an underside of the seat surface and terminating on a plane which is generally parallel to a plane defined by the seat surface.

* * * * *